US010062988B1

(12) United States Patent
Vinther et al.

(10) Patent No.: US 10,062,988 B1
(45) Date of Patent: Aug. 28, 2018

(54) CONNECTOR ASSEMBLY FOR ATTACHING A CABLE TO AN ELECTRICAL DEVICE

(71) Applicant: Ardent Concepts, Inc., Hampton Beach, NH (US)

(72) Inventors: Gordon A Vinther, Hampton Beach, NH (US); Sergio Diaz, Cambridge, MA (US); Joseph F DiDonna, Lee, NH (US)

(73) Assignee: Ardent Concepts, Inc., Hampton, NH (US)

( * ) Notice: Subject to any disclaimer, the term of this patent is extended or adjusted under 35 U.S.C. 154(b) by 0 days.

(21) Appl. No.: 15/708,852

(22) Filed: Sep. 19, 2017

Related U.S. Application Data

(60) Provisional application No. 62/396,448, filed on Sep. 19, 2016, provisional application No. 62/436,160, filed on Dec. 19, 2016.

(51) Int. Cl.

| | |
|---|---|
| ***H01R 13/24*** | (2006.01) |
| ***H01R 12/71*** | (2011.01) |
| ***H01R 13/652*** | (2006.01) |
| ***H01R 13/622*** | (2006.01) |
| ***H01R 12/70*** | (2011.01) |
| ***H01R 13/08*** | (2006.01) |

(52) U.S. Cl.
CPC ..... *H01R 12/716* (2013.01); *H01R 12/7005* (2013.01); *H01R 13/08* (2013.01); *H01R 13/622* (2013.01); *H01R 13/652* (2013.01)

(58) Field of Classification Search
CPC .... H01R 13/652; H01R 13/622; H01R 13/08; H01R 12/7005; H01R 12/716
USPC ..... 439/95, 378, 700
See application file for complete search history.

(56) References Cited

U.S. PATENT DOCUMENTS

| | | | | |
|---|---|---|---|---|
| 3,275,970 A * | 9/1966 | Johanson | ..... | H01R 24/40 439/263 |
| 6,261,130 B1 * | 7/2001 | Huynh | ..... | H01R 9/2416 439/700 |
| 6,350,155 B1 * | 2/2002 | Mullinger-Bausch | ..... | H01R 35/04 439/30 |
| 6,861,862 B1 * | 3/2005 | Tate | ..... | G01R 1/0466 324/756.02 |
| 7,972,173 B1 * | 7/2011 | Hyzin | ..... | H01R 13/2421 439/578 |

(Continued)

*Primary Examiner* — Hae Moon Hyeon
*Assistant Examiner* — Nelson R Burgos-Guntin
(74) *Attorney, Agent, or Firm* — Altman & Martin; Steven K Martin

(57) ABSTRACT

A connector assembly for terminating cables to a PCB. An interface of compliant contacts within in a cylindrical disk of dielectric material and a boss with the cable attached reciprocate within a cylindrical sleeve with the interface toward the PCB. Springs bias the interface and boss toward the PCB. The sleeve, interface, boss/cable assembly, and springs are slid into a barrel that has a pair of pawls extending paraxially from the proximal end. The pawls combine with paraxial alignment fingers on the sleeve. In the unattached position, the circular alignment posts fit into round PCB holes. As the connector is pushed toward the PC, the sleeve contacts the PCB and stops, but the barrel continues until it is free to rotate to an attached position where the pawl fingers slide under the PCB. An optional locking mechanism locks the barrel in the attached position.

6 Claims, 12 Drawing Sheets

(56) References Cited

U.S. PATENT DOCUMENTS

| | | | | |
|---|---|---|---|---|
| 8,562,380 | B2 * | 10/2013 | Li | H01R 13/701<br>439/700 |
| 8,926,342 | B2 * | 1/2015 | Vinther | H01R 9/032<br>439/79 |
| 9,130,328 | B1 * | 9/2015 | Huang | H01R 13/2421 |
| 9,748,688 | B2 * | 8/2017 | Hagmann | H01R 13/187 |

* cited by examiner

CONNECTOR ASSEMBLY FOR ATTACHING A CABLE TO AN ELECTRICAL DEVICE

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical cable attachments to circuit boards and other planar electrical devices (PCB), more particularly, to quickly, temporarily terminating an interconnect to a PCB with the mating pressure needed to make a good connection.

2. Description of the Related Art

One purpose of a cable termination is to provide a separable electrical interconnection between a cable and a PCB or other planar electrical device. The characteristic of separability means that the cables are not interconnected by permanent mechanical means, such as soldering or bonding, but by temporary mechanical means.

Currently, cables are terminated using a conventional-type connector which is also controlled-impedance, like an SMA (SubMiniature Version A) connector, or the cables are soldered to the PCB which is then separably connected to the working environment. The SMA connectors, while being generally the same impedance environment as the cable, have impedance mismatches that cause high-frequency attenuation at the point of interface between the cable and the connector and between the connector and its working environment, like a PCB. Additionally, these cable terminations often require through holes in PCBs for mounting and consequently can make it difficult to design the best possible controlled-impedance environment. Solder-down versions exist, but they cannot be removed and reused after being installed.

These types of cable terminations are generally for a single cable. They often require turning a mating connector several times for proper seating, either manually or with a calibrated torque wrench. Allowances must be made for fingers or for the torque wrench when spacing multiple connectors on a board, thereby requiring a substantial amount of board real estate to terminate, and decreasing the density capability of connections.

BRIEF SUMMARY OF THE INVENTION

The present invention is a connector assembly for terminating one or more cables to an electrical device, such as a printed circuit board (PCB), without screws or other latching hardware that cannot be removed without using tools. The connector assembly also does not require extra connectors to be soldered to the PCB. The connector assembly also provides a secure connection to the PCB for all typical thicknesses of PCB. The connector assembly imparts enough Z-axis force on the PCB to maintain a stable and repeatable interconnection.

The connector assembly uses compliant contact technology on a spring-loaded interface that does not require a mating half of a connector on the PCB. In one configuration, the interface is made of discrete, electrical, preferably compliant, contacts disposed within apertures in a cylindrical disk of dielectric material which holds the contacts in the correct orientation to make an electrical connection between a cable and the PCB. In another configuration, the interface is made of a sheet of isotropic conductive elastomer that conducts only in the Z axis extending perpendicularly between to its two parallel faces.

The cable is attached to a boss, an electrically-conductive, cylindrical ferrule. A through hole accepts the cable and the cable ground shield is electrically attached to the boss.

The interface and boss/cable assembly reciprocate freely within the bore of a cylindrical sleeve with the interface toward the PCB. An annular shoulder retains the interface within the sleeve. A boss spring and a sleeve spring bias the interface and boss/cable assembly, respectively, toward the PCB.

The sleeve has a pair of opposed knobs extending radially adjacent to the distal end and a pair of opposed alignment fingers extending paraxially from the proximal end. The alignment fingers make up the inner portion of alignment posts.

The sleeve, interface and boss/cable assembly, boss spring, and sleeve spring are slid into the bore of a barrel. The sleeve knobs fit into windows in the wall of the barrel. The barrel has a pair of opposed pawls extending paraxially from the proximal end. The pawls combine with the alignment fingers to form the alignment posts with circular cross-sections. Perpendicular fingers at the end of the pawls grab onto the underside of the PCB when the barrel is turned to the attached position.

An optional locking mechanism to prevents the connector assembly from inadvertently returning to the unattached position. The locking mechanism includes a hollow, cylindrical locking tube that slides into the upper portion of the barrel bore over the cable, boss spring, and sleeve spring and. Grips extending radially from the sides of the locking tube fit into slots at the distal end of the barrel. Rectangular tabs extend coaxially from the proximal end. Offset to one corner of the tab is a notch. The locking tube is biased toward the PCB by a locking tube spring.

All of the components are retained in the correct position in the barrel by a cap at the distal end of the barrel. The cap has a hole through which the cable enters the connector assembly.

To receive the connector assembly, the PCB has a pair of round holes for the alignment posts. Midway between the holes is the signal pad surrounded by a ground land.

The connector assembly is designed for a specific range of thicknesses of PCB. If necessary, the PCB thickness can be modified by building up or countersinking the underside of the PCB.

In the unattached position, the alignment posts are circular in cross-section so that they can fit into the PCB holes and the sleeve knob is resting on a proximal edge of the barrel window. A sloped edge of the window prevents the barrel from rotating relative to the sleeve. The end of the locking tube tab is resting against the sleeve knob so that the locking tube tab notch is not aligned with the knob.

The alignment posts are inserted in the PCB holes and pushed toward the PCB against the force of the boss and sleeve springs. The sleeve contacts the PCB and stops, but the barrel continues so that the knobs move from the window proximal edge. With the knobs no longer resting on the window proximal edges, the barrel is free to rotate relative to the sleeve. The barrel is rotated so that the pawl fingers slide under the PCB while the sleeve alignment fingers remain stationary in the holes.

The locking tube rotates with the barrel relative to the sleeve to where the locking tube notch aligns with the knobs and the locking tube spring pushes the locking tube downwardly until the knobs are within the notches, thereby engaging the locking mechanism. When pressure toward the PCB is released, the boss and sleeve springs impart enough Z-axis force on the PCB to maintain a stable connection.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporates by reference in their entireties U.S. Provisional Patent Application Nos. 62/396,448 and 62/436,160, on which this application is based.

The present invention, shown in FIGS. 1-10, is a connector assembly for terminating a cable to an electrical device, such as a printed circuit board (PCB), without screws or other latching hardware that cannot be removed without using tools. The term, PCB, in the remainder of the present specification is intended to include all electrical devices to which the termination of the present invention can attach. The terms "proximal" and "distal" in the present specification refer to directions toward the PCB and the away from the PCB, respectively. For example, the proximal end of the connector assembly is the end that attaches to the PCB.

The connector assembly 10 of the present invention also does not require extra connectors to be soldered to the PCB 12 before connectors can be mated. The connector assembly 10 only requires one or more holes 122 in the PCB 12 to receive alignment posts 18.

The connector assembly 10 also provides a secure connection to the PCB 12 for all typical thicknesses of PCB 12. The connector assembly 10 imparts enough Z-axis force on the PCB 12 to maintain a stable and repeatable interconnection.

Figure 9:
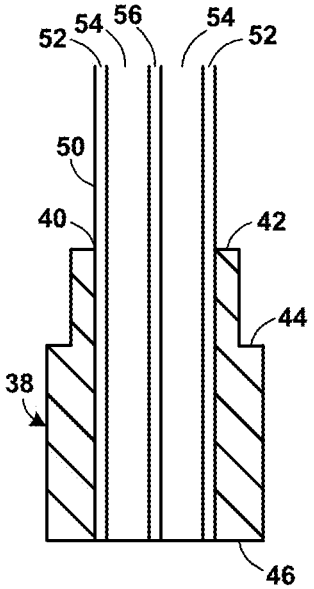
FIG. 9 is a cross-sectional view of an embodiment of the boss as attached to the cable.

The connector assembly 10 is for use with controlled-impedance cables having one or more signal conductors. As shown in FIG. 9, a coaxial cable 50 has a signal conductor 56 surrounded by a dielectric 54 with a ground reference shield 52 outside the dielectric 54. Optionally, a sheath covers the shield 52. Although not specifically described, the present invention can be adapted to accommodate cables having two or more signal conductors.

Figure 8:
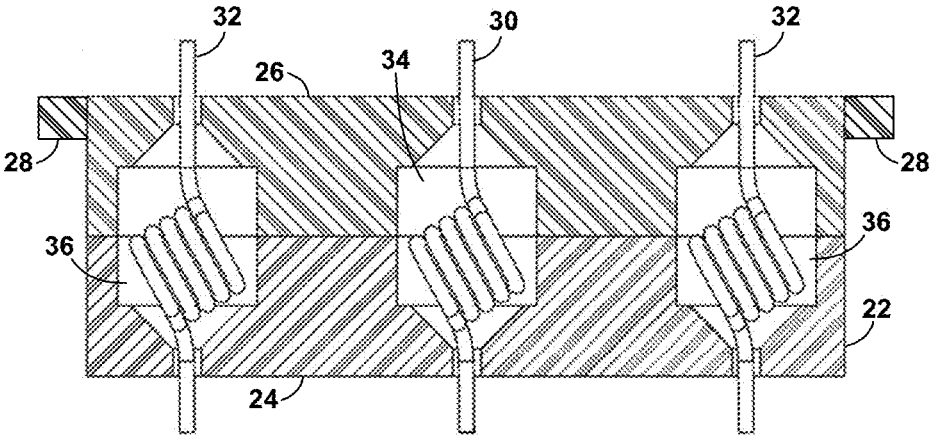
FIG. 8 is a cross-sectional view of an embodiment of the interface.

The connector assembly 10 uses compliant contact technology on a spring-loaded interface 20 that does not require a mating half of a connector on the PCB 12. In one configuration, the interface 20 is made of discrete electrical contacts 30, 32 disposed within a cylindrical disk 22 of dielectric material which holds the contacts 30, 32 in the correct orientation to make an electrical connection between the cable 50 and the PCB 12. The contacts 30, 32 are made of a conductive material such as metal or conductive elastomer. A cross-sectional view of an example of an interface 20 is shown in FIG. 8 and includes the dielectric disk 22 with a proximal face 24 and a distal face 26. At least one signal contact 30 in a signal contact through aperture 34 and a plurality of ground contacts 32 in ground contact through apertures 36 extend through the disk 22 between the proximal face 24 to the distal face 26. The ground contacts 32 are arranged in a manner known in the art to provide an appropriate controlled-impedance environment. Preferably, the contacts 30, 32 are compliant contacts.

In another configuration, the interface 20 is made of a sheet of isotropic conductive elastomer, which is a resilient sheet of elastomer that conducts only in the Z axis extending perpendicularly between to its two parallel faces.

The term, "contact", in the present specification and claims is intended to include all manners of signal transfer, including the discrete compliant contacts, the isotropic conductive elastomer, and any other compliant electrically-conductive structures that can be adapted to the present invention.

As shown in FIGS. 5-7 and 9, the cable 50 is attached to a boss 38. The boss 38 is an electrically-conductive, cylindrical ferrule with a distal face 42, an proximal face 46, and an axial through hole 40 extending between the distal face 42 and proximal face 46. The through hole 40 accepts the cable 50 in the distal face 42. The ground shield 52 is electrically attached to the boss 38 by some mechanical means such as soldering or pressing. The cable dielectric 54 and signal conductor 56 extend to and are generally flush with the proximal face 46.

A spring force is applied to the distal face 42, as described below. Optionally, the spring force is applied to an optional annular shoulder 44.

Figure 5:
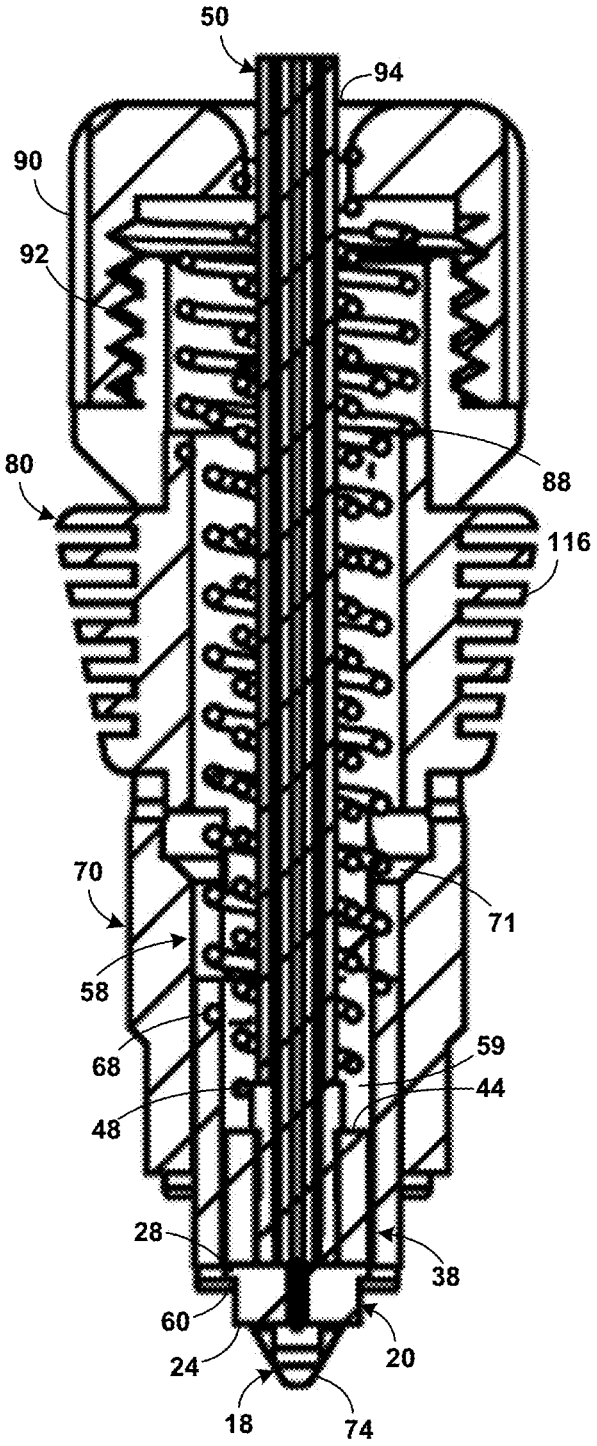
FIG. 5 is a cross-sectional view of the connector assembly of FIG. 3 at A-A.
Figure 6:
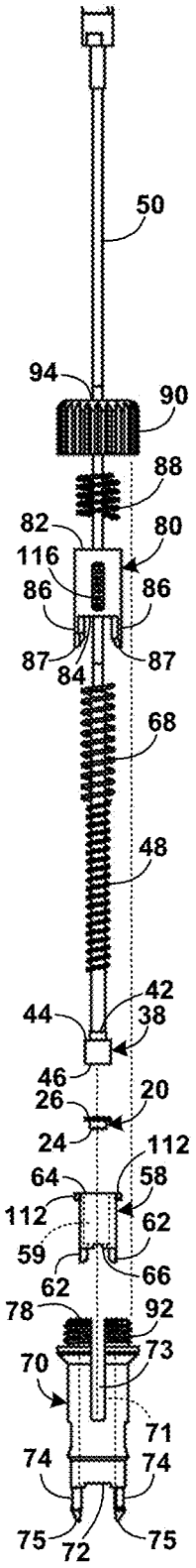
FIG. 6 is an exploded, front view of the connector assembly with a cable.
Figure 7:
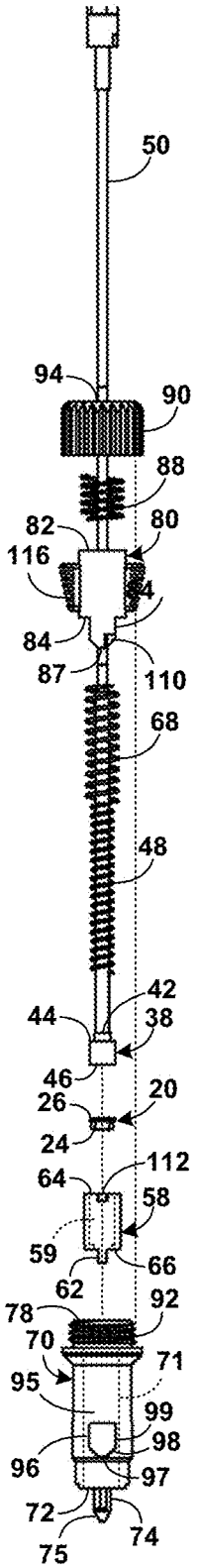
FIG. 7 is an exploded, side view of the connector assembly with a cable.

A cylindrical sleeve 58 with an axial bore 59 maintains the proper alignment of the interface 20, boss 38/cable 50 assembly, and the PCB 12, as shown in FIG. 5. The interface 20 reciprocates freely within the bore 59 at the proximal end 66 while being retained in the bore 59 and maintaining the proximal face 24 toward the PCB 12. Optionally, an annular shoulder 28 adjacent to the distal face 26 of the interface 20 abuts an internal annular shoulder 60 adjacent to the proximal end 66 of the bore 59 to retain the interface 20 within the sleeve 58, as shown in FIG. 5.

The boss 38/cable 50 assembly also reciprocates freely within the sleeve bore 59. The boss proximal face 46 abuts the distal face 24 of the interface 20 such that the signal contact 30 is aligned with and in electrical contact with the signal conductor 56 of the cable 50 and the ground contacts 32 are aligned with and in electrical contact with the proximal face 46 of the boss 38.

The present invention also contemplates that the interface 20 is integral with the boss 38. In other words, the interface 20 and boss 38 are a single unit with the compliant contacts 30, 32 and to which the cable 50 is attached. For example, a sheet of isotropic conductive elastomer acting as the interface 20 is mechanically attached to the proximal face of an electrically-conductive, cylindrical ferrule that acts as the boss 38. The cable 50 is attached to the ferrule as it would be to the boss 38.

The interface 20 and boss 38/cable 50 assembly are biased toward the PCB 12 by a small-diameter coil spring, the boss spring 48. The boss spring 48 fits over the cable 50, as in FIGS. 5-7, and, when the connector assembly 10 is assembled, abuts the boss distal face 42 or optional shoulder 44.

The sleeve 58 has a pair of opposed alignment fingers 62 extending paraxially from the proximal end 66. The alignment fingers 62 make up the inner portion of each alignment post 18, as described below.

The sleeve 58 has a pair of opposed knobs 112 extending radially adjacent to the distal end 26. The knobs 112 are described below.

The sleeve 58 is urged toward the PCB 12 by means of a middle-diameter coil spring, the sleeve spring 68. The sleeve spring 68 fits over the cable 50 and boss spring 48 and, when the connector assembly 10 is assembled, abuts the distal face 64 of the sleeve 58.

The sleeve 58 can be composed of a dielectric material or a conductive material. If a conductive material, the sleeve 58 can act as a radio frequency (RF) shield.

The sleeve 58 with the interface 20 and boss 38/cable 50 assembly installed in the bore 59, the boss spring 48, and the sleeve spring 68 are slid into the bore 71 of a barrel 70. The knobs 112 fit into windows 96 in the wall 95 of the barrel 70. Each window 96 has a flat proximal edge 97 that is the width of the knob 112. A sloped edge 98 slopes distally from one end of the proximal edge 97 to a longitudinal edge 99. The angle of the sloped edge 98 is preferably about 45°. The relationship between the knob 112 and window 96 is described below.

The barrel 70 has a pair of opposed pawls 74 extending paraxially from the proximal end 72. The pawls 74 form the proximal portion of each alignment post 18 by complementing the sleeve alignment fingers 62. Perpendicular fingers 75 at the end of the pawls 74 grab onto the underside 16 of the PCB 12 when the barrel 70 is turned to the attached position, as described below.

As will be described in more detail below, the connector assembly 10 attaches to the PCB 12 by the barrel rotating about the sleeve 58 from an unattached position to an attached position. The connector assembly 10 optionally includes a locking mechanism to prevent the connector assembly 10 from inadvertently returning to the unattached position.

In the present configuration, the locking mechanism includes a hollow, cylindrical locking tube 80 that fits over the cable 50, boss spring 48, and sleeve spring 68 and slides into the upper portion of the barrel bore 71. Grips 116 extending radially from the sides of the locking tube 80 fit into slots 73 at the distal end 78 of the barrel 70. Generally rectangular tabs 86 extend coaxially from the proximal end 84. Offset to one corner of the tab 86 is a notch 110.

The locking tube 80 is biased toward the PCB 12 by a large-diameter coil spring, the locking tube spring 88. The locking tube spring 88 fits over the cable 50, sleeve spring 68, and boss spring 48, and abuts the distal end 82 of the locking tube 80. The locking tube spring 88 biases the locking tube 80 towards the PCB 12 so that when the barrel 70 and the sleeve 58 are at a particular angle to one another, the locking tube 80 is pushed into place. The operation of the locking mechanism is described in detail below.

All of the components are retained in the correct position in the barrel 70 by a cap 90 that is mechanically attached to the distal end 78 of the barrel 70. Any method of mechanical attachment is contemplated. In the present configuration, the cap 90 is turned onto a thread 92 at the distal end 78 of the barrel 70. The cap 90 has a hole 94 through which the cable 50 enters the connector assembly 10.

Figure 1:
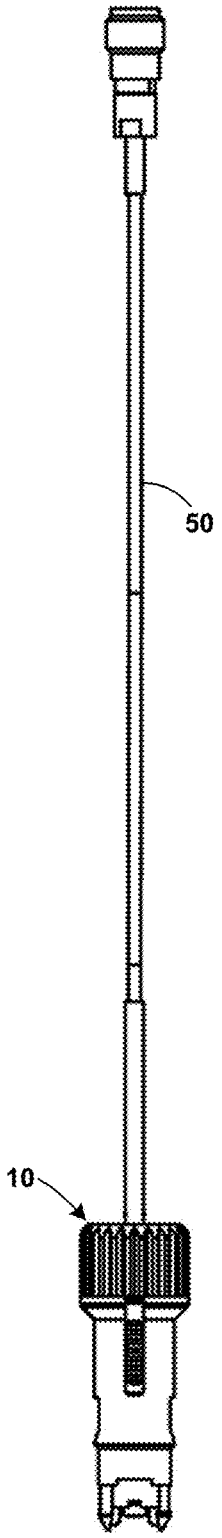
FIG. 1 is a front view of the connector assembly of the present invention with a cable.
Figure 2:
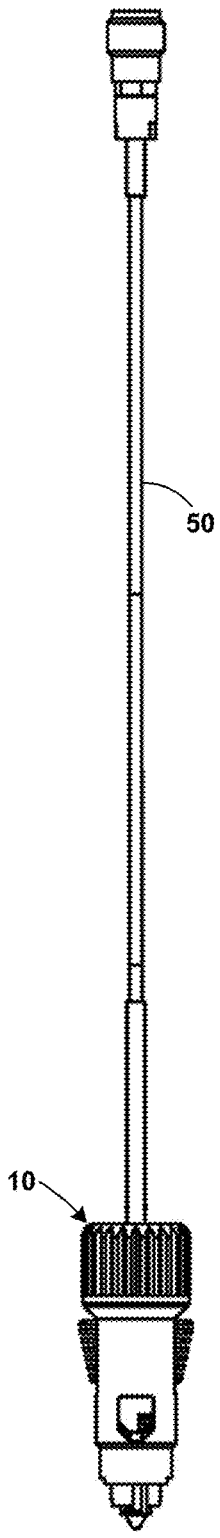
FIG. 2 is a side view of the connector assembly with a cable.
Figure 3:
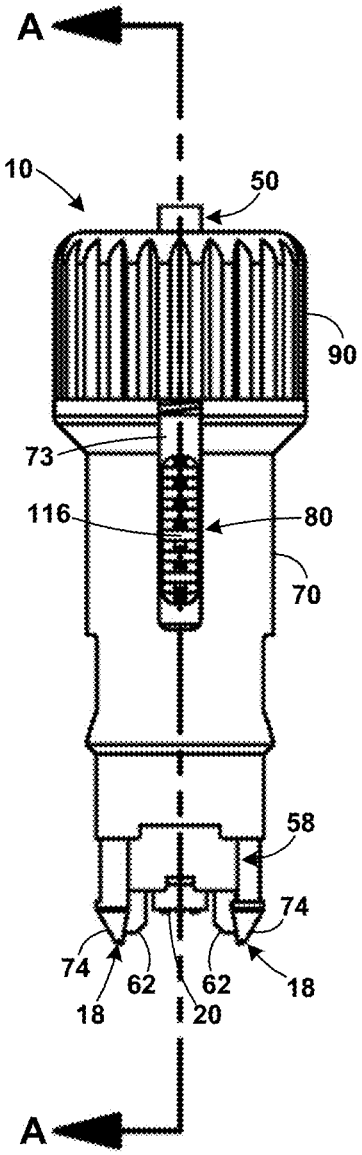
FIG. 3 is a detail view of the connector assembly of FIG. 1.
Figure 4:
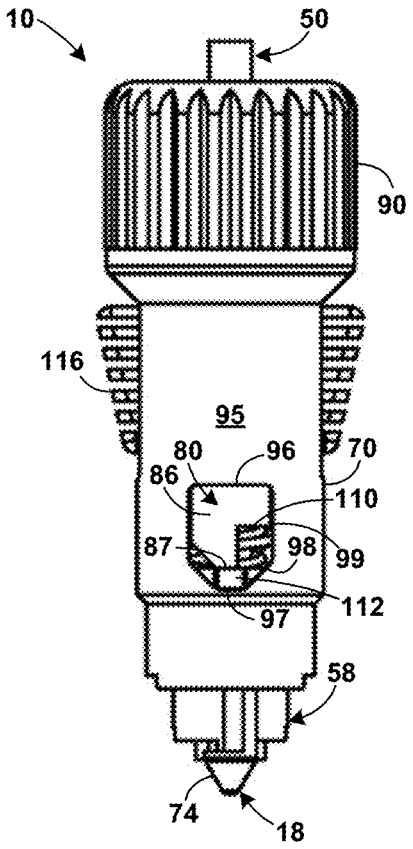
FIG. 4 is a detail view of the connector assembly of FIG. 2.
Figure 10:
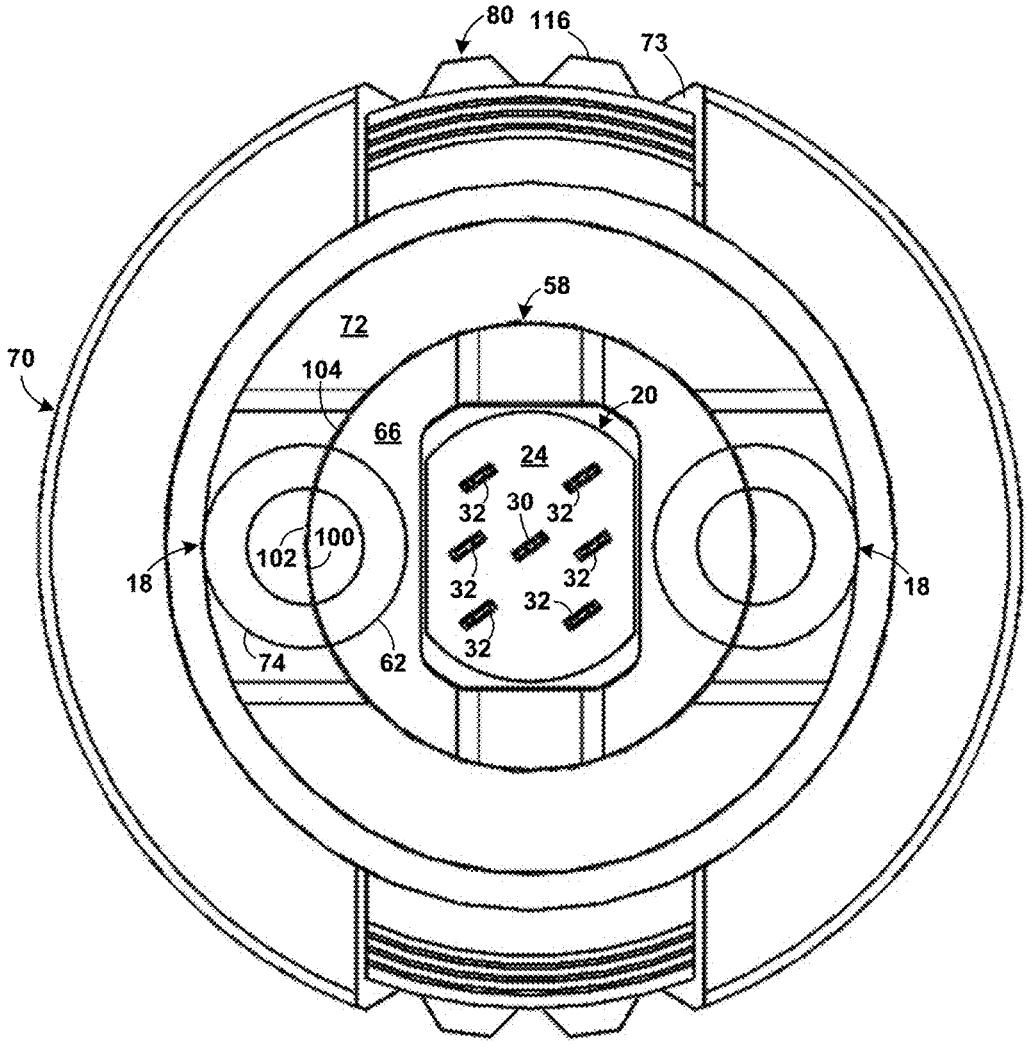
FIG. 10 is a bottom view of the assembled connector assembly.
Figure 11:
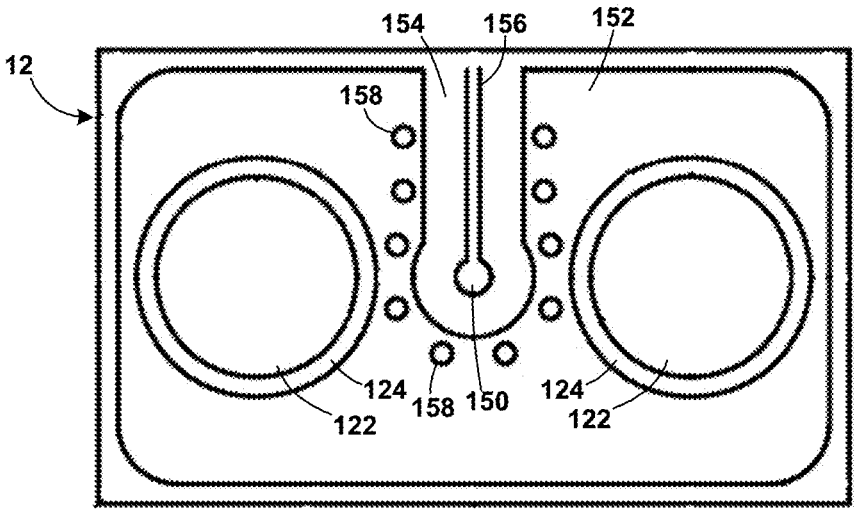
FIG. 11 shows a top view of a section of a PCB with a break in the ground land adapted to receive the connector assembly.
Figure 12:
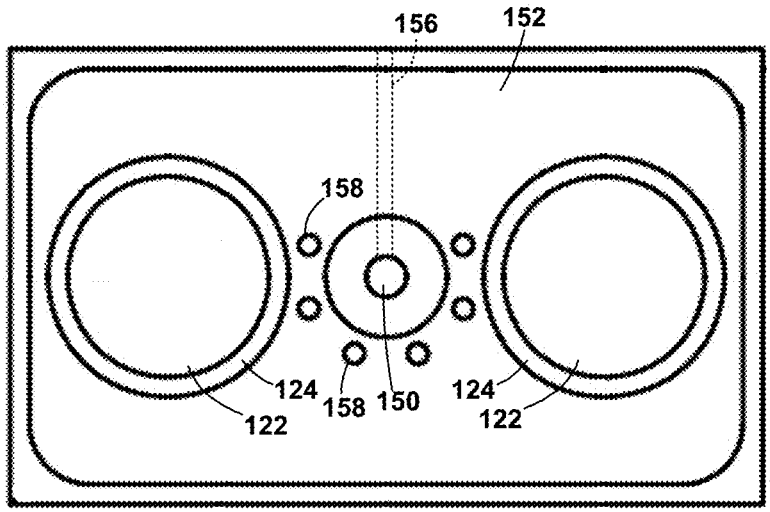
FIG. 12 shows a top view of a section of a PCB with an unbroken ground land adapted to receive the connector assembly.
Figure 13:
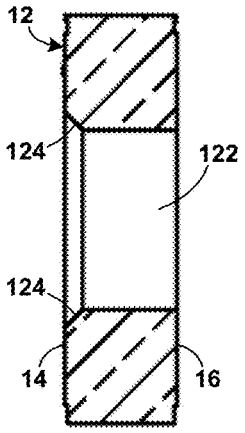
FIG. 13 shows a cross-sectional view of the section the PCB having the design thickness adapted to receive the connector assembly.

As mentioned above, when the connector assembly 10 is assembled, the sleeve alignment fingers 62 and the pawls 74 join together longitudinally to form the alignment posts 18, as shown in FIGS. 3 and 10. As shown in FIG. 10, the alignment post 18 has a circular cross-section. The sleeve alignment finger 62 has a convex curved surface 100 that abuts a complementary concave curved surface 102 on the pawl 74. The curvature of the complementary surfaces 100, 102 of both alignment posts 18 form a circle, as at 104, so that when the barrel 70 is rotated, the concave surface 102 of the pawl 74 slides along the convex surface 100 of the alignment finger 62.

The present invention contemplates that the connector assembly 10 can be designed for use with one cable 50, as described herein, or with two or more cables. The invention is not limited to coaxial cables, as the invention can be designed to accommodate twinaxial and multiaxial cables. Two cables can be used to connect to a differential pair on the PCB 12.

FIGS. 11-16 show how the PCB 12 is adapted to receive the connector assembly 10. The PCB 12 has a pair of round holes 122 that are slightly larger in diameter than that of the alignment posts 18 and are adapted to receive the alignment posts 18. Optionally, the edge of the holes 122 are beveled, as at 124 in FIG. 13, to more easily insert the alignment posts 18 into the holes 122. The preferred bevel angle is approximately 45° but can be in the range of from 15° to 75°.

Midway between the holes 122 is the signal pad 150. The signal pad 150 is nearly completely surrounded by a ground land 152. The ground land 152 will typically surround the holes 122, as in FIG. 11. A break 154 in the ground land 152 permits the signal trace 156 to pass through to the signal pad 150. Alternatively, the ground land 152 completely surrounds the signal pad 150 and the signal trace 156 reaches the signal pad 150 through a different layer of the PCB 12, as in FIG. 12.

Vias 158 connect the ground land 152 to inner ground layers on the PCB 12.

The connector assembly 10 is designed for a specific range of thicknesses of PCB 12. Parameters that determine the range of PCB thicknesses include the length of the alignment posts 18, the spring displacement of the interface 20, the compliance of the contacts 30, 32, and the distance of the upper surface 76 of the pawl fingers 75 from the interface 20.

Figure 14:
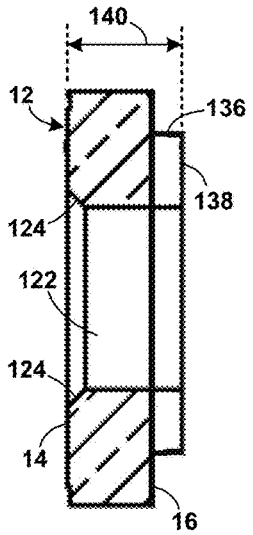
FIG. 14 shows a cross-sectional view of the section the PCB thinner than the design thickness adapted to receive the connector assembly.

If the PCB 12 is thinner than the minimum design thickness, the underside 16 of the PCB 12 can be built up, as at 136 in FIG. 14, so that the distance 140 from the outside surface 138 of the built-up section 136 to the top surface 14 of the PCB 12 is within the thickness range for which the connector assembly 10 designed.

Figure 15:
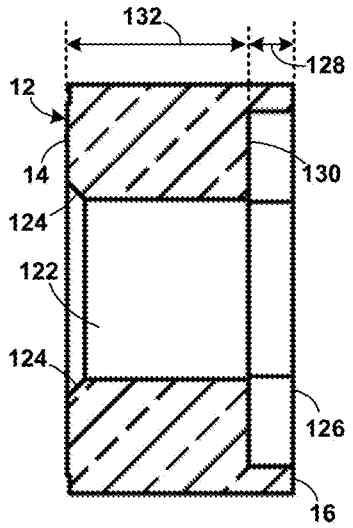
FIG. 15 shows a cross-sectional view of the section the PCB thicker than the design thickness adapted to receive the connector assembly.
Figure 16:
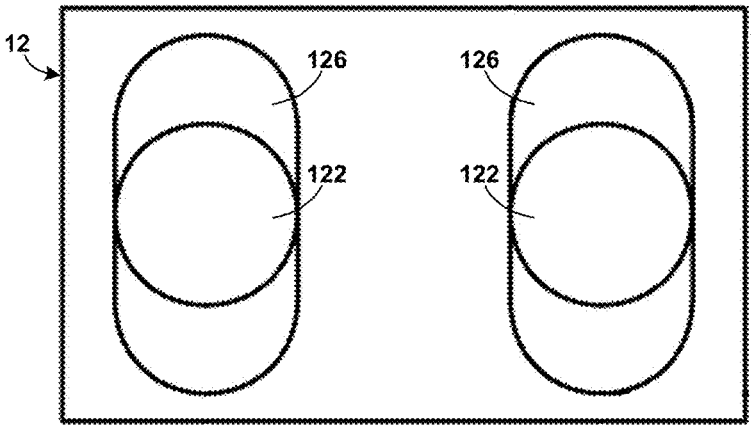
FIG. 16 shows a bottom view of the section the PCB thicker than the design thickness adapted to receive the connector assembly.

Alternatively, if the PCB 12 is thicker than the maximum design thickness, the holes 122 can have countersinks 126 on the underside 16 of the PCB 12, as shown in FIGS. 15 and 16. The depth 128 of the countersink 126 is such that the distance 132 from the inner surface 130 of the countersink 126 to the top surface 14 of the PCB 12 is within the thickness range for which the connector assembly 10 is designed.

Typically, the diameter of the holes 122 is 0.001 inch larger than the diameter of the alignment post 18. For example, the hole diameter to receive a 0.1-inch-diameter alignment post 18 is 0.101 inch.

Figure 17:
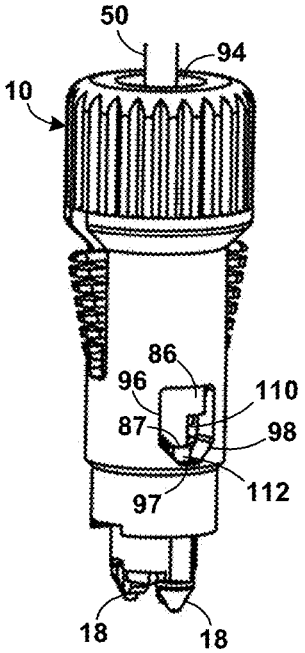
FIG. 17 is a side perspective view of the connector assembly prior to attachment.
Figure 18:
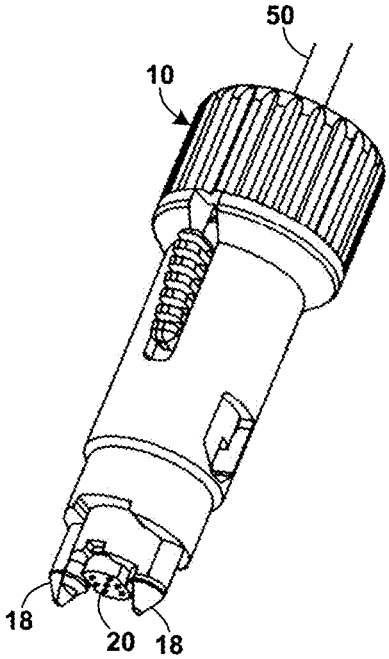
FIG. 18 is a bottom perspective view of the connector assembly prior to attachment.
Figure 19:
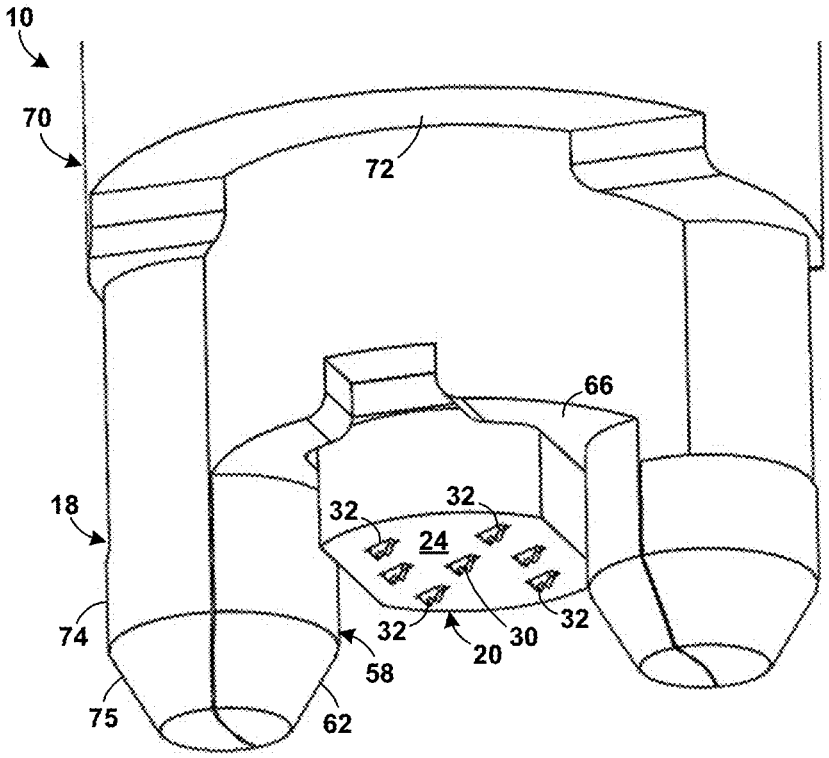
FIG. 19 is a bottom perspective detailed view of the connector assembly prior to attachment.

FIGS. 17-28 show how the connector assembly 10 is attached to a PCB 12. In FIGS. 17-19, the connector assembly 10 is shown in its unattached position. In the unattached position, the alignment posts 18 are circular in cross-section so that they can fit into the PCB holes 122. The sleeve knob 112, biased by the sleeve spring 68, is resting on the proximal edge 97 of the barrel window 96. The sloped edge 98 prevents the barrel 70 from rotating relative to the sleeve 58. This keeps the barrel 70 and sleeve 58 properly aligned with each other. The end 87 of the locking tube tab 86, biased by the locking tube spring 88, is resting against the sleeve knob 112. Consequently, the locking tube tab notch 110 is not aligned with the knob 112.

Figure 20:
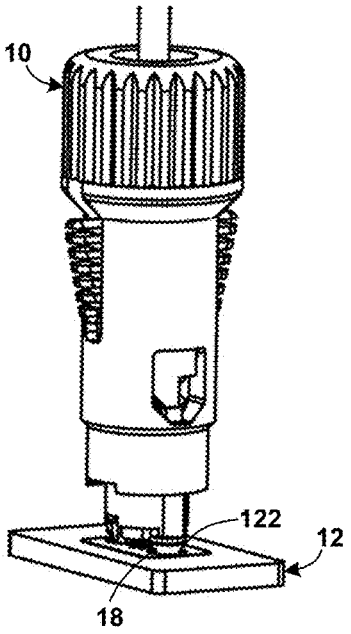
FIG. 20 is a side perspective view of the connector assembly beginning insertion into the PCB.

In FIG. 20, the alignment posts 18 of the connector assembly 10 are just introduced into the PCB holes 122.

Figure 21:
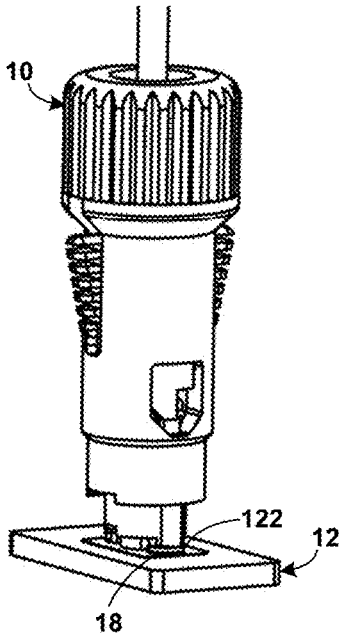
FIG. 21 is a side perspective view of the connector assembly inserted into the PCB with the interface contacting the PCB.

In FIG. 21, the alignment posts 18 are inserted to the point that the signal contact 30 touches the signal pad 150 and the ground contacts 32 touch the ground land 152.

Figure 22:
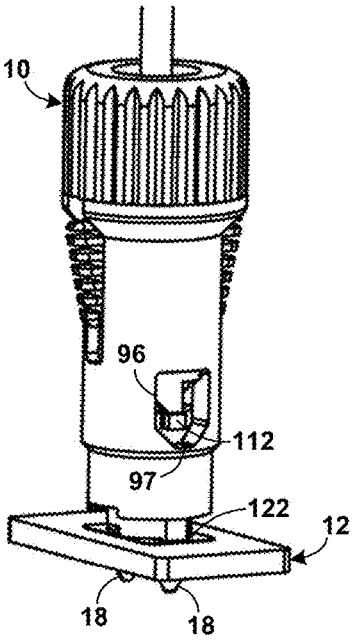
FIG. 22 is a side perspective view of the connector assembly fully inserted into the PCB.
Figure 23:
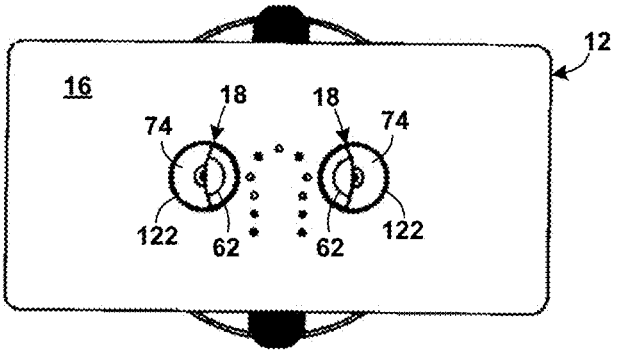
FIG. 23 is a bottom view of the connector assembly fully inserted into the PCB.

In FIGS. 22 and 23, the connector assembly 10 is pushed toward the PCB 12 against the force of the boss spring 48 and the sleeve spring 68. The proximal end 66 of the sleeve 58 contacts the PCB 12 and stops, but the barrel 70 continues. As the barrel 70 continues, the window 96 moves proximally but the knobs 112 do not. Consequently, the knobs 112 move distally from the window proximal edge 97, as in FIG. 22. With the knobs 112 no longer resting on the window proximal edges 97 and being blocked by the sloped edges 98, the barrel 70 is free to rotate relative to the sleeve 58.

The interface 20 is compliant due to the boss spring 48 and the compliant contacts 30, 32, thereby providing the connector assembly 10 with great signal integrity by keeping the interface 20 flat on the PCB 12.

Figure 24:
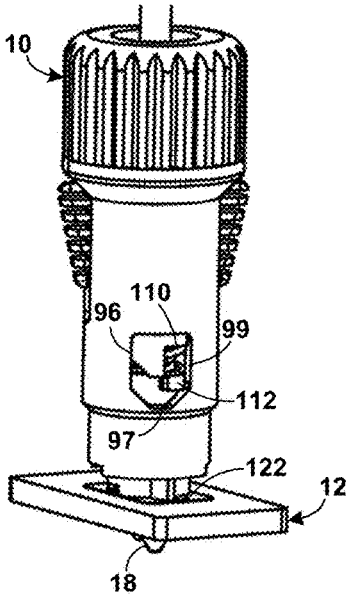
FIG. 24 is a side perspective view of the connector assembly and PCB with the pawls rotated.
Figure 25:
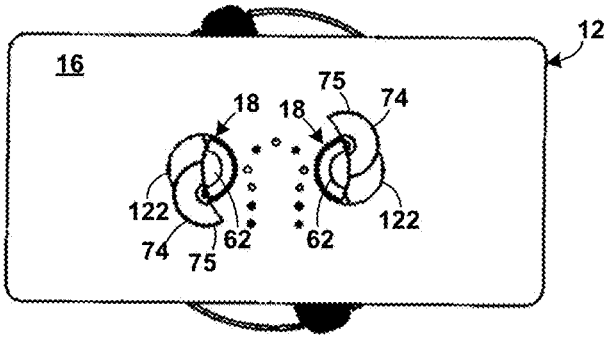
FIG. 25 is a bottom view of the connector assembly and PCB with the pawls rotated.

In FIGS. 24 and 25, the barrel 70 is rotated clockwise (as viewed from the distal end) to engage the pawls 74 while the sleeve alignment fingers 62 remain stationary in the holes 122. The knobs 112 contact the longitudinal edges 99 of the window 96, limiting rotation of the barrel 70.

Figure 26:
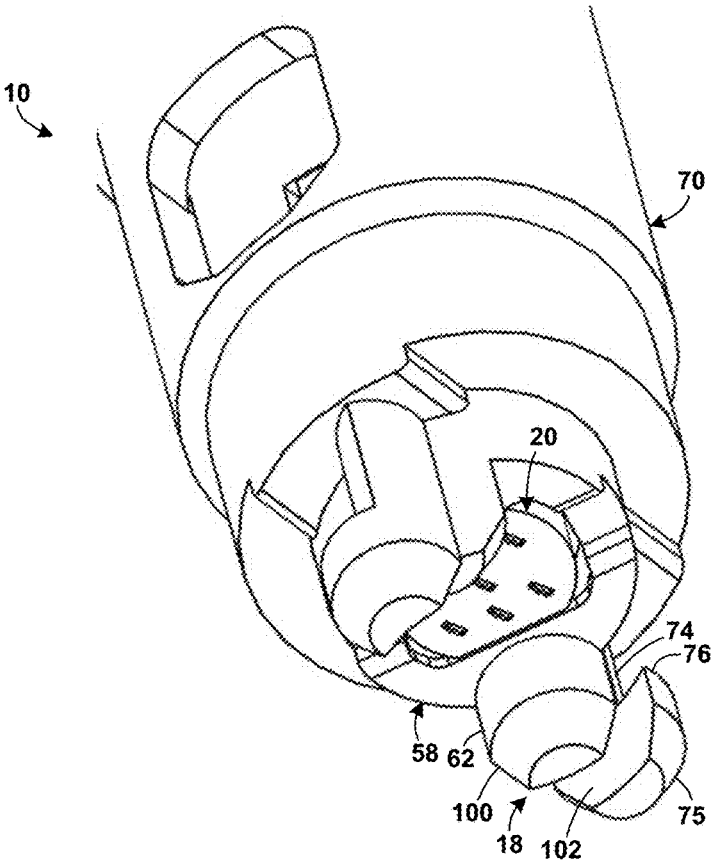
FIG. 26 is a bottom perspective view of the connector assembly alone with the pawls rotated.

As seen in FIG. 26, each pawl 74 has a finger 75 that is perpendicular to the longitudinal axis of the pawl 74. When the barrel 70 is rotated, the pawls 74 slide along the alignment fingers 62 until the pawl fingers 75 no longer form circular cross-sections with the alignment fingers 62. The upper surfaces 76 of the pawl fingers 75 engage the underside 16 of the PCB 12.

Figure 27:
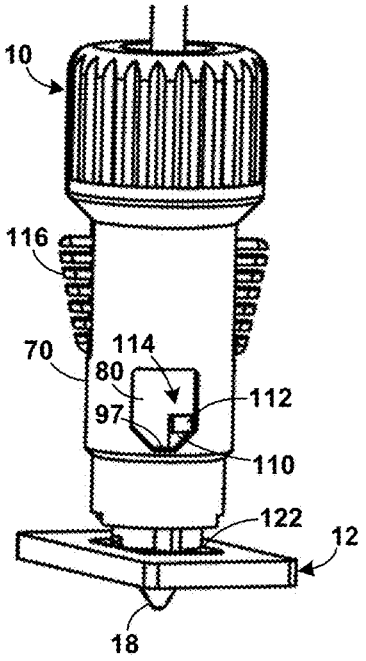
FIG. 27 is a side perspective view of the connector assembly fully attached to the PCB.
Figure 28:
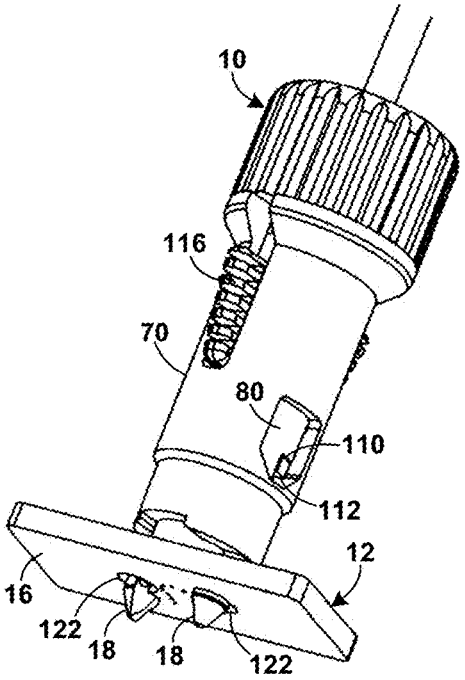
FIG. 28 is a bottom perspective view of the connector assembly fully attached to the PCB.

In FIGS. 27 and 28, the locking tube 80 rotates with the barrel 70 relative to the sleeve 58, being pulled along by the locking tube grips 116 in the barrel grip slots 73. When the locking tube 80 rotates to where the locking tube notch 110 aligns with the knobs 112, approximately 20° in the present design, the locking tube spring 88 pushes the locking tube 80 downwardly until the knobs 112 are within the notches 110, as at 114 in FIG. 27, thereby engaging the locking tube 80. With the locking tube 80 engaged, the barrel 70 cannot be rotated back and the rotational angle between the sleeve 58 and the barrel 70 is maintained, thereby insuring that the pawl fingers 75 remain under the PCB 12 and that the alignment posts 18 cannot be retracted from the PCB holes 9.

When pressure toward the PCB 12 is released from the connector assembly 10, the boss spring 48 and sleeve spring 68 impart enough Z-axis force on the PCB 12 to maintain a stable connection.

To remove the connector assembly 10, the locking tube grips 116 are pulled away from the PCB 12 and against the locking tube spring 88. The result is that the locking tube 80 is pulled away so that the knobs 112 are no longer within the notches 110. The barrel 70 is rotated counterclockwise by the knobs 112 sliding down the sloped edge 98 of the window 96 to the proximal edge 97. At the same time, the boss spring 48 and the sleeve spring 68 push the connector assembly 10 off the PCB 12 and the connector assembly 10 returns to the unattached position.

Thus it has been shown and described a connector assembly for attaching a cable to an electrical device. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An electrical connector assembly comprising:

(a) an electrical cable having at least one cable signal conductor, a dielectric surrounding the cable signal conductor, and a shield surrounding the dielectric;

(b) a cylindrical barrel with an axial bore, a proximal end, a distal end opposite the proximal end, a pair of opposed barrel windows, and a pair of opposed pawls extending paraxially from the proximal end, each pawl having a perpendicular pawl finger, and each barrel window having a proximal edge and a sloped edge extending distally from the proximal edge at an angle to a longitudinal edge;

(c) a cylindrical sleeve with an axial bore, a proximal end, and a distal end, sleeve knobs extending radially adjacent to the distal end, and a pair of opposed alignment fingers extending paraxially from the proximal end, the sleeve being within the barrel bore such that the alignment fingers and pawls abut each other longitudinally to form a pair of opposed alignment posts with a circular cross-section and the sleeve knobs rest on the proximal edge of the barrel windows;

(d) a cylindrical interface with a distal face and a proximal face, the interface having a compliant signal contact extending between the distal face and the proximal face for each cable signal conductor, and at least one compliant ground contact extending between the distal face and the proximal face, the interface reciprocating within the axial bore of the sleeve and the axial bore of the sleeve at the proximal end of the sleeve;

(e) an electrically-conductive, cylindrical boss having a distal face, a proximal face, and an axial through hole between the distal face and the proximal face, the cable extending into the distal face with the cable shield electrically attached to the boss and the cable signal conductor and dielectric extending to the proximal face, the boss reciprocating within the axial bore of the sleeve with the boss proximal face abutting the interface distal face so that the signal contact makes electrical contact with the cable signal conductor and the at least one ground contact makes electrical contact with the boss;

(f) a boss spring biasing the boss and interface toward the sleeve proximal end;

(g) a sleeve spring biasing the sleeve toward the barrel proximal end;

(h) a cap with a hole through which the cable extends from the boss, the cap mechanically attached to the barrel distal end to retain the sleeve, interface, boss, boss spring, and sleeve spring within the barrel;

(i) whereby, when the barrel is rotated in a predetermined direction relative to the sleeve from an unattached position to an attached position, the unattached position being when the alignment posts have a circular cross-section and the sleeve knobs rest on the proximal edges of the barrel windows for proper alignment between the barrel and the sleeve, and the attached position being when the pawl fingers no longer form a circular cross-section with the alignment fingers.

2. The electrical connector assembly of claim 1 further comprising a locking mechanism for locking the assembly in the attached position, the locking mechanism comprising:

(a) opposed paraxial grip slots at the distal end of the barrel;

(b) a cylindrical locking tube with a proximal end, a distal end, an axial bore, opposed paraxial grips at the proximal end, and opposed tabs extending paraxially from the proximal end, each tab having a tab end with an offset notch, the locking tube being within the barrel bore with the grips in the grip slots and the locking tube tab ends abutting the sleeve knobs;

(c) a locking tube spring biasing the locking tube tabs against the sleeve knobs; and (d) the cap retaining the locking tube and locking tube spring within the barrel;

(e) whereby, when the barrel is rotated from the unattached position to the attached position, the tabs rotate relative to the sleeve knobs until the sleeve knobs align with the notches and the locking tube spring pushes the locking tube proximally so that the sleeve knobs are within the notches, thereby preventing the barrel from being rotated to the unattached position, and (f) whereby, when the grips are pulled toward the cap, the notches are pulled from the sleeve knobs, and the barrel can be rotated to the unattached position.

3. The electrical connector assembly of claim 1 wherein the sleeve has an annular shoulder in the axial bore adjacent to the proximal end, the interface has an annular shoulder adjacent to the distal face, and the interface is retained within the axial bore of the sleeve by the interface annular shoulder abutting the sleeve annular shoulder.

4. The electrical connector assembly of claim 1 wherein the interface is composed of a non-conductive material, the signal contact resides in a signal aperture extending between the distal face and the proximal face, and each ground contact resides in a ground aperture extending between the distal face and the proximal face.

5. The electrical connector assembly of claim 1 wherein the signal contact and the at least one ground contact are provided by an isotropic conductive elastomer.

6. The electrical connector assembly of claim 1 further comprising a cap thread at the distal end of the barrel and the cap being mechanically attached to the distal end by turning onto the cap thread.

* * * * *